United States Patent [19]

Sargent

[11] Patent Number: 4,950,133

[45] Date of Patent: Aug. 21, 1990

[54] AIR BLOWER ASSEMBLY

[75] Inventor: Ronald J. Sargent, Escondido, Calif.

[73] Assignee: Alopex Industries, Inc., San Marcos, Calif.

[21] Appl. No.: 271,998

[22] Filed: Nov. 15, 1988

[51] Int. Cl.[5] ..... F04B 39/00

[52] U.S. Cl. ..... 417/312; 417/423.14; 4/542

[58] Field of Search ..... 417/423.2, 423.14, 424.1, 417/423.9, 312, 313; 181/224, 225, 202, 256; 4/542, 543, 544

[56] References Cited

U.S. PATENT DOCUMENTS 4,248,570 2/1981 Conger ..... 417/423.14

4,258,821 3/1981 Wendt et al. ..... 181/202

4,560,395 12/1985 Davis ..... 415/119

*Primary Examiner*—Leonard E. Smith

*Assistant Examiner*—John A. Savio, III

[57] ABSTRACT

An air blower for a spa or the like having an outside enclosure formed by a cover that is fitted tightly onto a base, with a blower-and-motor unit centrally located in the enclosure and air inlet passages extending from the bottom wall of the base along opposite sides thereof upwardly into an air chamber in the cover, to the intake of the blower. An acoustical foam lining is provided for the air intake chamber, and the blower is mounted in a nest of acoustical foam and clamped against an internal platform on the base. Blocks of acoustical foam in the air inlet passages in the base, on opposite sides of a central outlet passage, overlie the inlets through the platform into the air chamber, blocking straight-line paths through the passages and partially covering the wall of the outlet passage.

18 Claims, 2 Drawing Sheets

FIG. 1
PRIOR ART
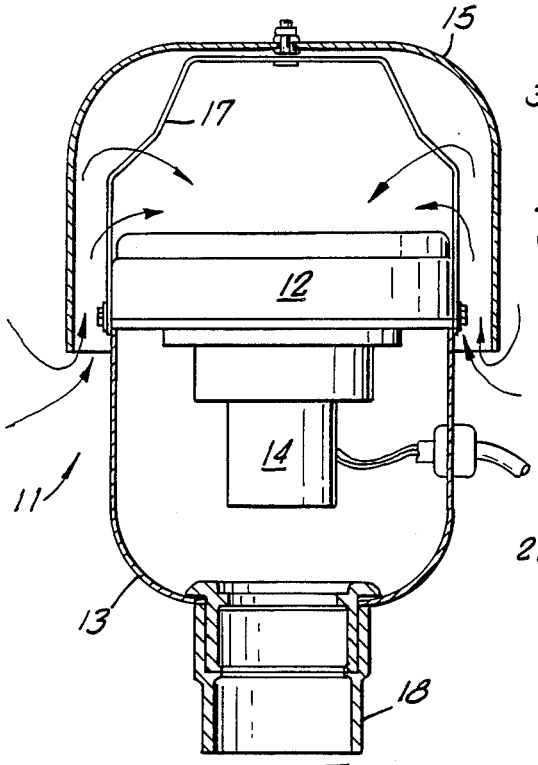
FIG. 2.
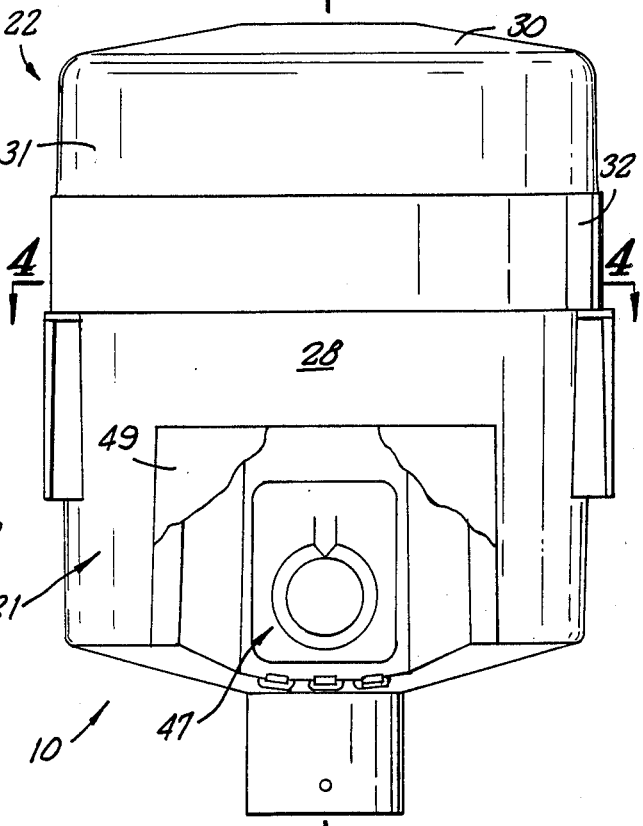
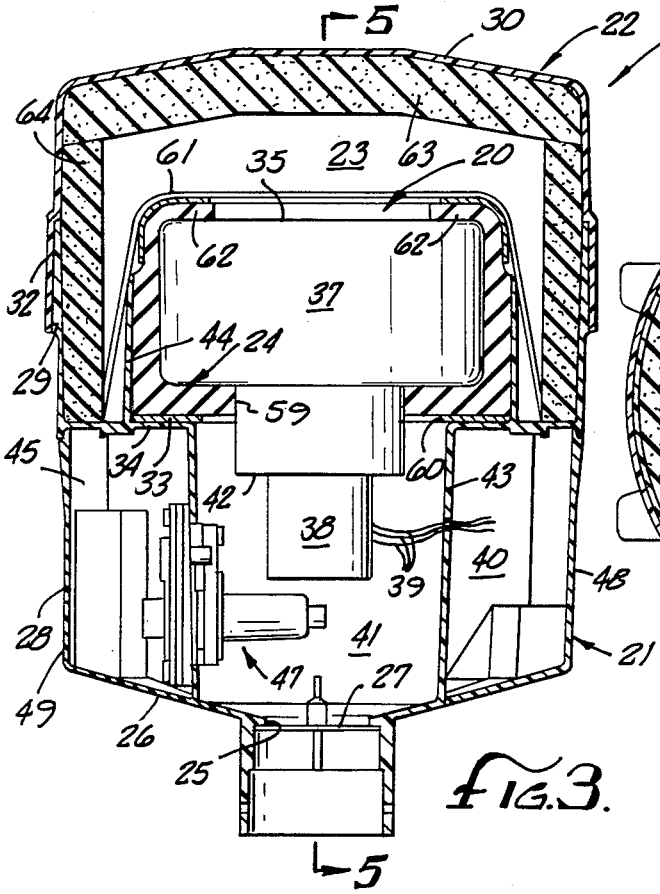
FIG. 3.
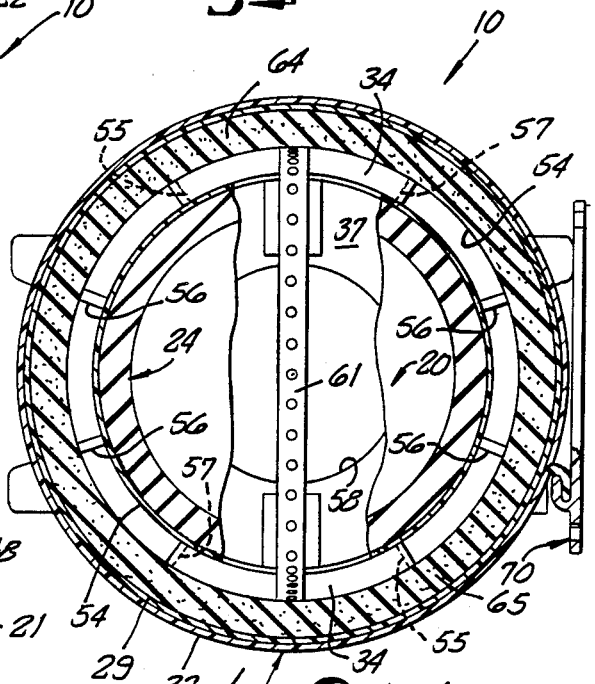
FIG. 4.

AIR BLOWER ASSEMBLY

BACKGROUND OF THE INVENTION

The present invention relates to air blower assemblies, and has particular reference to air blower assemblies for aerating spa tubs to create a bubbling effect in the water.

Such air blower assemblies have long been used in spa tubs, and are popular accessories for enhancing the enjoyment of bathing in the tub. Typically, the assembly is enclosed with the water heating and circulation equipment, and has selectively operable controls for activating the assembly, when desired, to force air into the spa tub through a pattern of air holes provided in the tub.

One disadvantage of such blower assemblies has been the noise that is associated with them. The assemblies include blower-and-motor units that operate at high speed to produce the necessary flow of air under pressure to the spa tub, and the combination of motor/fan noise and the rushing air typically produces a relatively high-pitched whine that detracts from the atmosphere of the spa.

Efforts have been made to reduce this noise by enclosing the assembly in sound-barrier insulation, and in some cases the assembly even has been buried in the ground near the spa tub to muffle the noise. Other attempts have been directed to the selection of quieter blower-and-motor units, and to the covering of the blower-and-motor units in a manner that muffles the noise. An example of a relatively quiet prior blower assembly of this type is that manufactured by Alopex Industries and sold under the trademark ANZEN, having a cup-shaped base in which the blower-and-motor unit is supported and an upper hood-like cover around which air enters the enclosure and flows to the fan.

The objective of the present invention is to provide a substantially improved air blower assembly that is significantly quieter in operation than prior blowers, thereby enhancing the atmosphere associated with the spa tub.

SUMMARY OF THE INVENTION

The present invention resides in an air blower assembly for use in spas and the like in which the noise produced by the blower-and-motor unit and by the air flowing through the blower is effectively confined within the blower assembly and blocked against escape. This is accomplished by enclosing the blower-and-motor unit in an outer enclosure including a cover composed of sound barrier material and lined with acoustical foam, supporting the unit internally in a nest of acoustical foam that substantially encloses the motor, lengthening the air inlet path to the fan to extend from the opposite end of the base past the unit to the air inlet of the fan, and providing acoustical barrier material to make the air inlet path tortuous, thereby blocking straight line paths for the escape of noise from the enclosure.

More specifically, in the preferred embodiment of the invention, the cover of the enclosure is composed of acoustical barrier material and interfits tightly with the base, and also has layers of acoustical foam that line the endwall and the sidewall of the cover. The fan is supported in a cup-shaped nest of acoustical foam on an internal platform in the enclosure, beneath the lined air inlet chamber in the cover, and the nest and the fan are clamped tightly against the platform to reduce noise-producing vibration.

To form the elongated tortuous air inlet path or paths, one or more air inlet ports are formed in the lower end wall of the base, which preferably is cup-shaped and has a central outlet port, and one or more air inlet passages extend upwardly from the inlet ports, along the sidewall of the base to the air chamber in the cover. The platform for the blower-and-motor unit has openings which form inlets to the air chamber, and these openings are masked by blocks of acoustical foam that line the inner sides of the inlet passages and overlie the inlet openings in the platform.

Other features and advantages of the invention will become apparent from the following detailed description, taken in conjunction with the accompanying drawings.

BRIEF DESCRIPTION OF THE DRAWINGS

FIG. 1 illustrates the prior art and is a cross-sectional view taken in a vertical plan through a blower assembly, the blower-and-motor unit thereof being shown in side elevation;

FIG. 2 is an enlarged side elevational view of a blower assembly in accordance with the present invention, a side cover being partially broken away to expose a control compartment;

FIG. 3 is a cross-sectional view taken substantially along line 3—3 of FIG. 2;

FIG. 4 is a cross-sectional view taken substantially along line 4—4 of FIG. 2, with internal parts broken away for clarity and showing an illustrative mounting bracket;

DETAILED DESCRIPTION OF THE PREFERRED EMBODIMENT

Figure 5:
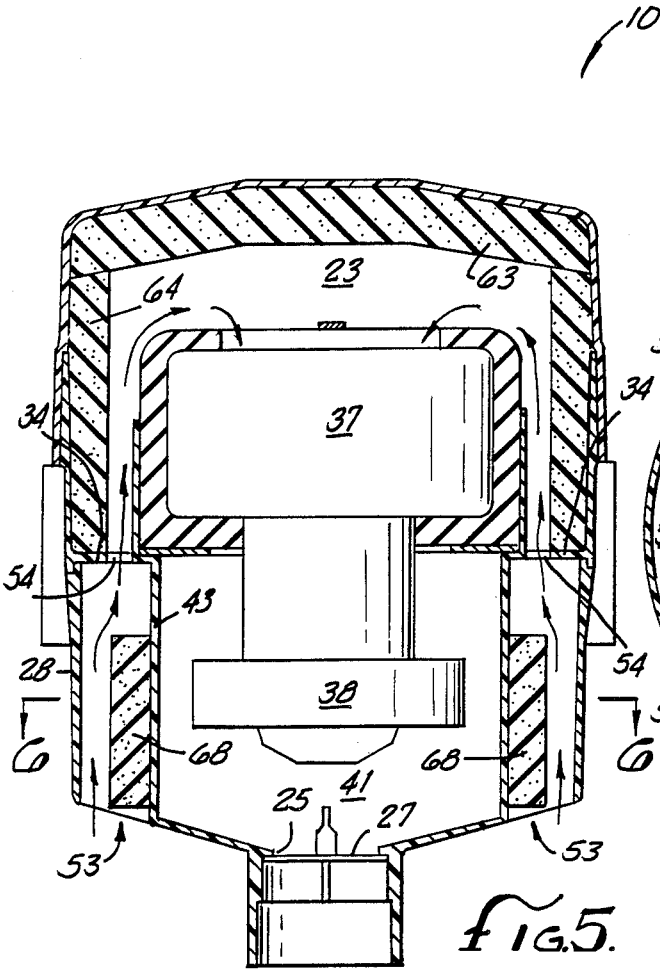
FIG. 5 is a view similar to FIG. 3 but taken in a plane that is substantially normal to the line 3—3 in FIG. 2.

As shown in FIGS. 2 through 6 of the drawings for purposes of illustration, the invention is embodied in an air blower assembly, indicated generally by the reference number 10, constituting a significant improvement over the prior art, represented by the air blower assembly 11 shown in FIG. 1. That prior art air blower assembly comprises a blower 12 that is attached to the top of a cup-shaped base 13 with an electric motor 14 suspended from the blower in the base, and a hood 15 that is mounted above the base on a metal frame 17 extending upwardly from the base. The blower draws air from the air space in the hood, and into the hood around the base as indicated by the arrows in FIG. 1, and discharges the air through an outlet fitting 18 in the bottom of the base, for delivery to a spa (not shown).

Blower assemblies of this type produce noise in varying degrees, depending upon the type of motor, the materials of the base and the hood, which typically have been metal, and the specific design of these parts. Even the best of these, however, have been relatively noisy unless totally surrounded by a sound-insulating enclosure.

In accordance with the present invention, the blower-and-motor unit 20 of the improved air blower assembly 10 is supported in an outer case or enclosure in a manner that effectively confines the noise produced by these parts within the enclosure, resulting in significantly quieter operation than has been achieved with prior air blowers. For this purpose, the enclosure comprises a base 21 and a cover 22 that fit tightly together around the blower-and-motor unit, the cover defining an air chamber 23 around the inlet side of the blower unit and being lined with acoustical barrier material, and the unit is supported in a nest 24 of acoustical barrier material and clamped securely in place to reduce sound-producing vibration. In addition, the enclosure 21, 22 defines at least one elongated tortuous air inlet path, extending from the lower end of the enclosure to the air chamber 23, and acoustical barrier material is positioned along this path to block straight-line sound paths from the air chamber.

The base 21 is a cup-shaped, plastic molding having a central outlet port 25 in its lower endwall 26, preferably controlled by a one-way valve 27 permitting out-flow only, and having a sidewall 28 that preferably is circular in transverse cross-section and terminates in an upper rim 29 surrounding an open upper side. The cover 22 has an upper endwall 30 and a sidewall 31, also preferably circular in transverse cross-section, that terminates in a skirt 32 which telescopes snugly over the rim 29 of the base. These parts surround the blower-and-motor unit 20, which is generally centrally located in the enclosure and is supported on a platform 33 in the base in spaced relation with the walls of the enclosure. The platform herein comprises a ring-shaped plate and an internal ledge 34 that is molded integrally with the base.

Above and around the blower unit 20 is the air chamber 23 through which air flows to the upper, intake side 35 of the blower, the enlarged upper end portion 37 of the unit 20. The motor 38 hangs below the blower and is connected to electric wires 39 which extend laterally into a control compartment 40 in the side of the base. Below the motor is a central outlet passage 41 through which air flows from the lower, output side 42 of the blower, past the motor 38 and out through the outlet port 27.

The outlet passage 41 is defined within a partition wall 43 that is of generally oval transverse cross-section (see FIG. 6) and is an integral part of the base 21, and the ledge 34 is formed at the upper end of this partition wall. An upwardly opening generally cylindrical socket 44 is formed on top of the ledge, to support the nest 24 and the blower 35. Along the elongated sides of the oval partition wall, shown in FIG. 3, the compartment 40 is formed in one side of the base for housing the electrical parts on that side, the right side in FIG. 3. A compartment 45 is formed in the opposite side, providing access to the outer end of a thermostatic control 47 on the left side in FIG. 3. Removable covers 48 and 49 are provided for these compartments.

Figure 6:
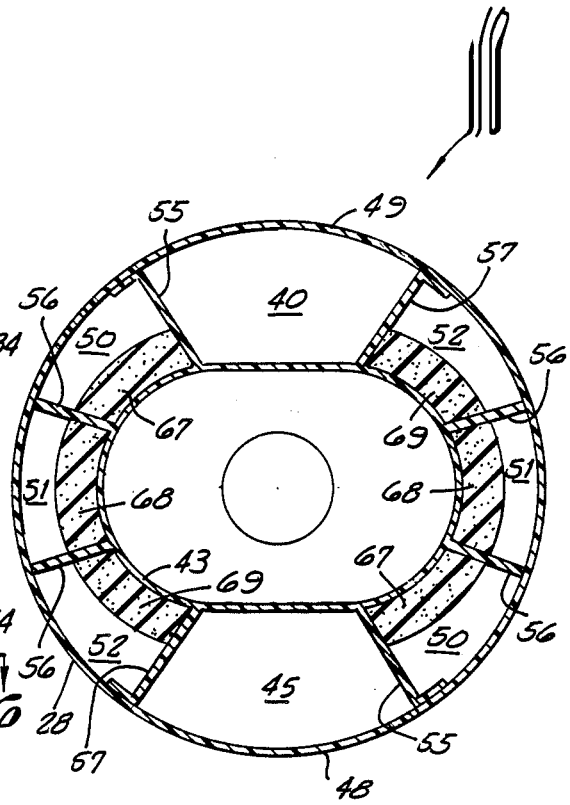
FIG. 6 is a cross-sectional view taken substantially along line 6—6 of FIG. 5.

As can be seen in FIGS. 5 and 6, the arcuate spaces between the sidewall 28 of the base and the arcuate ends of the partition wall 43 are divided longitudinally to form a plurality of elongated inlet passages 50, 51 and 52 extending from inlet openings 53 in the bottom wall of the base to inlets 54 through the ledge 34 into the air chamber 23 around the blower. The arcuate spaces are divided by longitudinal webs or ribs 55, 56 and 57 that are molded integrally in the base, and the upper ends of these webs support the ledge 34.

The blower 37 and the motor 38 are of conventional construction, the blower having an intake opening 58 (FIG. 4) in its top wall and having one or more outlets (not shown) in its bottom wall around the motor 38. The enlarged upper end portion of the blower is mounted in the nest 24 of acoustical barrier material, the nest being generally cup-shaped and having an open upper end (see FIG. 4) for admitting air into the blower, and a bottom wall extending under the blower and over the plate 33. The underside of the blower extends through an opening 59 in the nest and the center hole 60 of the plate 33, and the nest otherwise fills the space in the socket around the blower. A strap 61 overlies the nest and small extensions 62 thereof under the strap, and clamps both the nest and the blower tightly into the socket, to reduce vibration. This strap is fastened at its ends to the ledge 34 on opposite sides of the socket.

To line the air chamber 23 with acoustical barrier material, a layer 63 of acoustical foam is adhesively secured to the endwall 30 of the cover, and an elongated strip 64 of the acoustical foam is inserted in the cover to extend around the sidewall thereof, having ends which abut tightly against each other at 65 (FIG. 4). This strip has a width sufficient to cover the sidewall between the ledge 34 and the acoustical layer 63.

The inlet passages 50, 51 and 52 have blocks 67, 68 and 69 of acoustical foam material fastened, as by an adhesive, to the inside walls of the passages, that is, the walls formed by the arcuate ends of the partition wall 43. These blocks are shown in FIG. 6 as being sized and shaped to completely fill the spaces between the webs for an optimum barrier, but it should be noted that practical assembly considerations may make it desirable to make the blocks narrower than the spaces between the webs.

It can be seen in FIG. 5 that the blocks 67, 68 and 69 overlie the inlets 53 through the platform, and that the strip 64 and the blocks cooperate to form an indirect, tortuous path for air flowing into the air chamber 23 and to the blower. Conversely, this indirect inlet path avoids any straight-line exit path from the air chamber for sound waves, and this greatly reduces the escape of noise from the blower through the air inlet passages. It is believed that the blocks 67, 68 and 69 may also serve a sound-absorbing function with respect to motor noise tending to escape from the outlet passage 41 through the partition wall 43.

Shown in the drawings along with the relevant portions of the assembly 10 are secondary aspects of the assembly that are of general interest only. These include the control 47, the electrical components in the compartment 40, and an optional mounting bracket 70 (FIG. 4).

While acoustical barrier materials of various kinds may be used in the blower assembly 10, the presently preferred material for the cover lining 63 and strip 64 is open-cell, porous sound-absorbing foam material, preferably with embossed exposed surfaces. A suitable material of this type is that sold under the trademark CONAFLEX by H.L. Blachford, Inc., Corona, CA. For the nest 24, the preferred material is flexible, self-skinning open-cell foam barrier material, a suitable brand being that sold under the trademark BARYFOAM by H.L. Blachford, Inc. Finally, the cover 22 preferably is composed of a molded acoustical barrier material such as that sold under the trademark BARYSKIN. The base 21 preferably is composed of a suitable molded plastic material.

It has been shown through acoustical testing that the blower assembly 10 of the present invention constitutes a very significant improvement over the prior art, reducing the noise levels in operation to one-half or less the noise levels produced by prior blowers. Moreover, this is accomplished without hampering the air flows produced by the blower assembly, and while maintaining the cost of the assembly at a competitive level.

It will be evident that, while one embodiment of the blower assembly has been illustrated and described in detail, various modifications and changes may be made without departing from the spirit and scope of the invention.

I claim as my invention:

1. An air blower assembly, comprising:

a blower-and-motor unit having an enlarged upper end constituting a blower with an air intake on its upper side and an air outlet on its lower side;

a cup-shaped base having an open upper side, a sidewall and a lower end wall opposite said open side formed with a centrally located air outlet port, said unit being disposed in said base with said blower adjacent the open side of the base;

means in said base forming a supporting structure for said unit and including a platform extending across the base and having a central opening through which said unit hangs into the interior of said base, a nest composed of acoustical foam resting on said platform and surrounding said blower, said nest having a bottom wall formed with an opening that is aligned with the opening in said platform and an open top that overlies the air intake of said blower, and means clamping said unit and said nest against said platform;

an inverted cup-shaped cover fitted tightly over said open side of said base and including an end wall spaced above said blower, and a sidewall spaced outwardly from said blower and telescoping with the sidewall of said base to enclose the blower-and-motor unit and define an enclosed air chamber above said blower;

layers of acoustical foam covering the end wall and sidewall of said cover above said platform, and leaving an air chamber between said blower and the layers of acoustical foam;

means in said base defining at least one air inlet port in said end wall of said base and at least one elongated air passage from said air inlet port to said chamber, for admitting air into said blower;

and an acoustical foam barrier in said air passage defining a tortuous path between said chamber and said air inlet port and blocking any straight-line path in said air passage.

2. An air blower assembly as defined in claim 1 wherein said base has an internal partition wall between said platform and said end wall of said base, internally defining an outlet flow passage from said motor assembly to said outlet port and externally defining said elongated air passage as an annular space between the partition and the sidewall of the base, including at least one inlet opening through said platform to said chamber.

3. An air blower assembly as defined in claim 2 wherein a block of said acoustical foam is positioned in said air passage to lie between said inlet opening and said inlet port, thereby constituting said acoustical foam means.

4. An air blower assembly as defined in claim 3 wherein a plurality of inlet ports are formed in the end wall of said base, a plurality of air passages are formed in said base to extend from said inlet ports to inlet openings into said chamber, and a plurality of blocks of acoustical foam are positioned to form tortuous paths in said passages.

5. An air blower assembly as defined in claim 1 wherein said means clamping said unit in place include a cup-shaped socket on said platform extending around said nest.

6. An air blower assembly as defined in claim 5 wherein said clamping means further comprise a strap secured to said platform on opposite sides of said unit and clamping said nest and said unit tightly against said platform.

7. An air blower assembly as defined in claim 1 wherein said layers of acoustical foam and said barrier are composed of acoustical foam having embossed surfaces.

8. An air blower assembly as defined in claim 1 wherein said cover is composed of molded plastic acoustical barrier material.

9. An air blower assembly, comprising:

an outer enclosure comprising a cup-shaped base having an open side, a sidewall, and an endwall opposite said open side formed with a centrally located air outlet port, and an inverted cup-shaped cover fitted over said base and including an endwall and a sidewall cooperating with the base to form an enclosed air chamber in said cover;

a blower-and-motor unit positioned in said base adjacent said open side thereof and having an air intake facing toward said cover in said air chamber and an air outlet for directing air toward said outlet port;

means supporting said unit on said base, including an internal platform on said base, a cup-shaped acoustical foam nest covering the sides of said unit and extending partially between the unit and the platform;

layers of acoustical foam on the inner sides of said endwall and said sidewall of said cover, lining said air chamber around said unit;

means in said base defining at least one air inlet port in said endwall of said base and at least one air inlet passage extending through said base to said air chamber in said cover;

and an acoustical foam barrier in said inlet passage defining a tortuous path for air flow and blocking a straight-line path for sound therein.

10. An air blower assembly as defined in claim 9 wherein said unit includes a blower motor extending through said platform, said nest and said platform having holes therein for the motor.

11. An air blower assembly as defined in claim 9 wherein said base has a plurality of air inlet passages extending from the endwall of the base along the sidewall thereof and into said air chamber in said cover, said layers of acoustical foam in said cover including one layer on the sidewall of said cover overlying a substantial portion of said passages, and each of said inlet passages having an acoustical barrier therein in the form of a block of acoustical foam material that is offset inwardly relative to said one layer to define said tortuous path.

12. An air blower assembly as defined in claim 9 wherein said cover is composed of molded plastic acoustical barrier material.

13. An air blower assembly as defined in claim 9 further including means clamping said unit and said nest against said platform.

14. An air blower assembly, comprising:

a blower enclosure defining an enclosed compartment having opposite end walls;

a blower-and-motor unit mounted in said compartment between said endwalls and having an air intake facing toward one of said endwalls and a air outlet facing toward the other of said endwalls, said unit generally dividing said compartment to form an air inlet chamber around said air intake;

said enclosure having an outlet port in said other of said endwalls and having at least one air inlet port adjacent said other of said endwalls and including means in said enclosure defining at least one elongated air inlet passage extending from said air inlet port through said enclosure and past said blower-and-motor unit to said air inlet chamber;

acoustical barrier material lining said air inlet chamber and substantially surrounding said blower-and-motor unit therein;

and acoustical barrier material in said inlet air passage.

15. An air blower assembly as defined in claim 14 wherein said blower-and-motor unit is supported by and substantially enclosed in a nest of acoustical barrier material.

16. An air blower assembly as defined in claim 14 wherein said acoustical barrier material in said inlet air passage includes at least one block of acoustical barrier material cooperating with the barrier material lining said air chamber to define a tortuous path.

17. An air blower assembly as defined in claim 14 wherein said enclosure has a plurality of air inlet ports in the endwall of said base, and a plurality of air inlet passages extending from said ports past said unit, with acoustical barrier material defining a tortuous path in each of said passages.

18. An air blower assembly as defined in claim 17 wherein said air chamber has an outer lining of acoustical barrier material overlying said inlet ports, and further including means defining a plurality of inlets into said air chamber alongside said blower-and-motor unit, said acoustical barrier material being disposed along the sides of said inlet passages to overlie said inlets and block straight-line paths therefrom to said inlet ports.

* * * * *